US005427207A

United States Patent [19]

Miyanishi

[11] Patent Number: 5,427,207

[45] Date of Patent: Jun. 27, 1995

[54] APPARATUS FOR RESCUING PASSENGERS IN A MALFUNCTIONING ELEVATOR

[75] Inventor: Yoshio Miyanishi, Inazawa, Japan

[73] Assignee: Mitsubishi Denki Kabushiki Kaisha, Tokyo, Japan

[21] Appl. No.: 243,084

[22] Filed: May 16, 1994

Related U.S. Application Data

[63] Continuation of Ser. No. 988,884, Dec. 10, 1992, abandoned.

[30] Foreign Application Priority Data

Dec. 11, 1991 [JP] Japan ..... 3-327662

[51] Int. Cl.[6] ..... B66B 5/02

[52] U.S. Cl. ..... 187/393; 187/391; 187/316; 187/277

[58] Field of Search ..... 187/104, 105, 107, 130, 187/133, 117, 134, 391, 393, 394, 316, 377, 247

[56] References Cited

U.S. PATENT DOCUMENTS 4,067,416 1/1978 Lowry ..... 187/29 R
4,350,225 9/1982 Sakata et al. .
4,367,810 1/1983 Doane et al. ..... 187/29 R
4,982,815 1/1991 Arabori et al. ..... 187/105

FOREIGN PATENT DOCUMENTS 2305783 12/1990 Japan .

*Primary Examiner*—Steven L. Stephan
*Assistant Examiner*—Robert Nappi
*Attorney, Agent, or Firm*—Leydig, Voit & Mayer

[57] ABSTRACT

An elevator control apparatus capable of reducing the risk of passengers being confined in an elevator car and capable of preventing damage to equipment as well as danger to passengers. The apparatus includes a safety circuit for detecting an abnormality of the elevator, a flip-flop for storing the operation of the safety circuit, a door-openable region detecting circuit for detecting that a position at which the car is stopped is within a region within which the door of the car can be opened, a control circuit for effecting a rescue operation on the basis of the outputs of the flip-flop and the door-openable region detecting circuit. After an operation of the safety circuit a control circuit continuously outputs a signal for canceling the memory of the flip-flop 35 after the passage of a first predetermined period of time until a second predetermined period of time passes. After the passage of the second predetermined period of time, the elevator car is prohibited from starting.

6 Claims, 4 Drawing Sheets

APPARATUS FOR RESCUING PASSENGERS IN A MALFUNCTIONING ELEVATOR

This application is a continuation of application Ser. No. 07/988,884 filed Dec. 10, 1992, now abandoned.

BACKGROUND OF THE INVENTION

1. Field of the invention

The present invention relates to an elevator control apparatus, and particularly, to an elevator control apparatus capable of automatically effecting a slow-speed rescue operation after a safety circuit of the apparatus has operated.

2. Description of the Related Art

FIG. 3 shows the construction of a conventional elevator control apparatus, such as that disclosed in Japanese Patent Laid-Open No. 2-305783. Referring to FIG. 3, the apparatus includes a safety circuit 1 for detecting abnormality of an elevator car (not shown) or other parts, a door-openable region detecting circuit 2 for determining whether or not the car is within a region within which the door of the car can be opened, a control circuit 3 using, for example, a microcomputer, and a drive device 4 for actuating a lifting motor 5 on the basis of the output of the control circuit 3. The control circuit 3 comprises an input circuit 31 connected to both the safety circuit 1 and the door-openable region detecting circuit 2, a central processing unit 32 (hereinafter abbreviated to "CPU") connected to the input circuit 31 for mutual data exchange, a memory 33 which is connected to the CPU 32 for mutual data exchange, and in which data such as a program related to the flowchart shown in FIG. 4 (described later) has previously been stored, and an output circuit 34, connected to the CPU 32 for mutual data exchange, for supplying the output of the CPU 32 to the drive device 4.

The operation of the apparatus shown in FIG. 3 will be described with reference to FIG. 4. Suppose that an abnormality has occurred during the traveling of the car, resulting in an operation of the safety circuit 1. A detection signal from the safety circuit 1 is fed to the CPU 32 via the input circuit 31, and then processed in accordance with a program already stored in the memory 33. Specifically, the CPU 32 determines whether or not the safety circuit 1 has operated, in Step S1. Since the safety circuit 1 has operated, a flag FSAFE is set to "1" in Step S2.

Subsequently, the CPU 32 determines whether or not the flag FSAFE is "1", in Step S3. Since the flag is "1", Step S4 is executed, in which a determination is made as to whether or not the car is stopped. If the car is not stopped, Step S5 is executed to determine, on the basis of the output from the door-openable region detecting circuit 2, whether or not the car is within a door-openable region. If the car is not within a door-openable region, Step S1 is again executed. If the car is within a door-openable region, Step S6 is executed, in which a stop command is given to the drive device 4 via the output circuit 34, so as to stop the motor 5, hence, stop the car, and open the door to allow passengers to get off the car, and in which restarting of the car is prohibited.

On the other hand, if the car is determined to be stopped in Step S4, CPU 32 executes Step S7 to determine, on the basis of the output from the door-openable region detecting circuit 2, whether or not the position at which the car has stopped in response to the operation of the safety circuit 1 is within a door-openable region. If that position is within a door-openable region, Step S8 is executed, in which the door is opened to allow the passengers to get off, and in which restarting of the car is prohibited. If it is determined, in Step S7, that the position at which the car is stopped is not within a door-openable region, Step S9 is executed, in which the CPU 32 commands, via the output circuit 34, the drive device 4 to perform an automatic low-speed operation, whereby the car is shifted to a rescue operation and starts traveling in this mode. When, after a car traveling in the rescue operation mode, the entrance of the car into a door-openable region has been determined in Step S5, Step S6 is executed, in which the car is stopped as described above, and the passengers are rescued at the nearest floor.

The conventional elevator control apparatus with the above-described construction entails the following problem. When the execution of a rescue operation has been determined, if the safety circuit keeps operating, the car cannot restart, thus rendering the rescue operation impossible. As a result, the passengers becomes confined in the elevator car. A method for coping with such difficulty may be adapted to simply wait for the safety circuit to return to its initial state, or to provide a plurality of rescue-operation opportunities at certain intervals of time. However, with such methods, the equipment may be damaged. If the safety circuit is actuated repeatedly, a sudden stop or the like may endanger the passengers.

SUMMARY OF THE INVENTION

The present invention is directed to overcoming the above-described problem. An object of the present invention is to provide an elevator apparatus which is safe and capable of reducing the risk of passengers being confined in a car.

In order to achieve the above object, according to the present invention, there is provided an elevator control apparatus for controlling a drive device for a car of an elevator, the apparatus comprising: a safety circuit for detecting an abnormality of the elevator; abnormality storing means for storing that the safety circuit has detected an abnormality; a door-openable region detecting circuit for detecting that a position at which the car is stopped is within a region within which the door of the car can be opened; and control means for controlling the drive device on the basis of the outputs of the abnormality storing means and the door-openable region detecting circuit, wherein, when the abnormality storing means has posted an abnormality detection, the control means stops the car within a door-openable region if the car is in motion, opens the door to allow passengers to get off the car, and thereafter prohibits restarting of the car, whereas the control means opens the door to allow passengers to get off the car if the car is stopped within a door-openable region, and thereafter prohibits restarting of the car, and the control means continues canceling, for a predetermined period of time, the abnormality detection stored in the abnormality storing means if the car is stopped within a region within which the door cannot be opened, the control means effecting a rescue operation when the abnormality detection has been canceled, and the control means prohibiting restarting of the car when the abnormality detection has not been canceled though the predetermined period of time has passed.

According to the present invention, an operation of the safety circuit is stored by the abnormality storing means. If the memory of the storing means has not been removed by the passage of a first predetermined period of time, the outputting of a canceling signal to the abnormality storing means is continued until the passage of a second predetermined period of time longer than the first predetermined period of time. After the second predetermined period of time has passed, the car is prohibited from starting. With this arrangement, if the safety circuit returns to its initial state between the passage of the first predetermined period of time and the passage of the second predetermined period of time, a rescue operation can be immediately entered. Thus, it is possible to reduce the risk of passengers being confined. Since the car is prohibited from starting after the passage of the second predetermined period of time, it is possible to prevent the risk of the used equipment being damaged and the risk of the passengers being endangered.

DESCRIPTION OF THE PREFERRED EMBODIMENT

Figure 1:
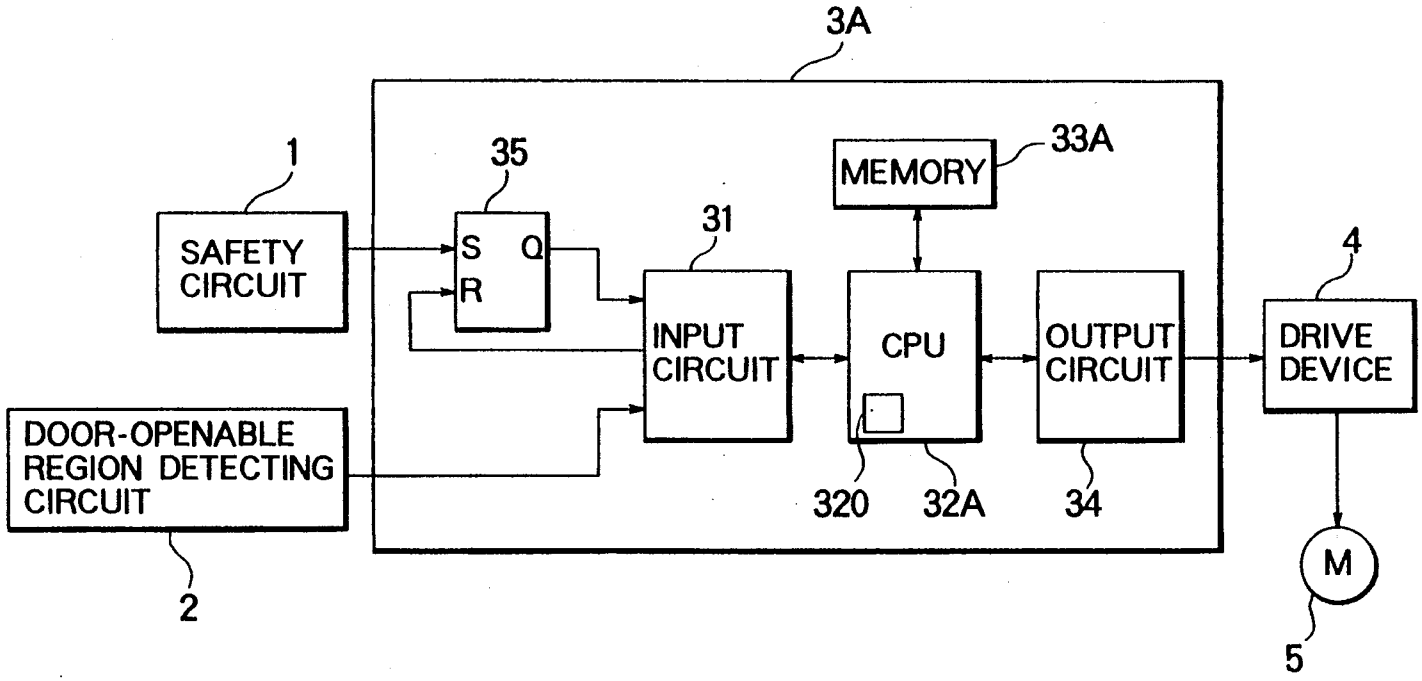
FIG. 1 is a diagram showing the construction of an embodiment of an elevator control apparatus according to the present invention.
Figure 3:
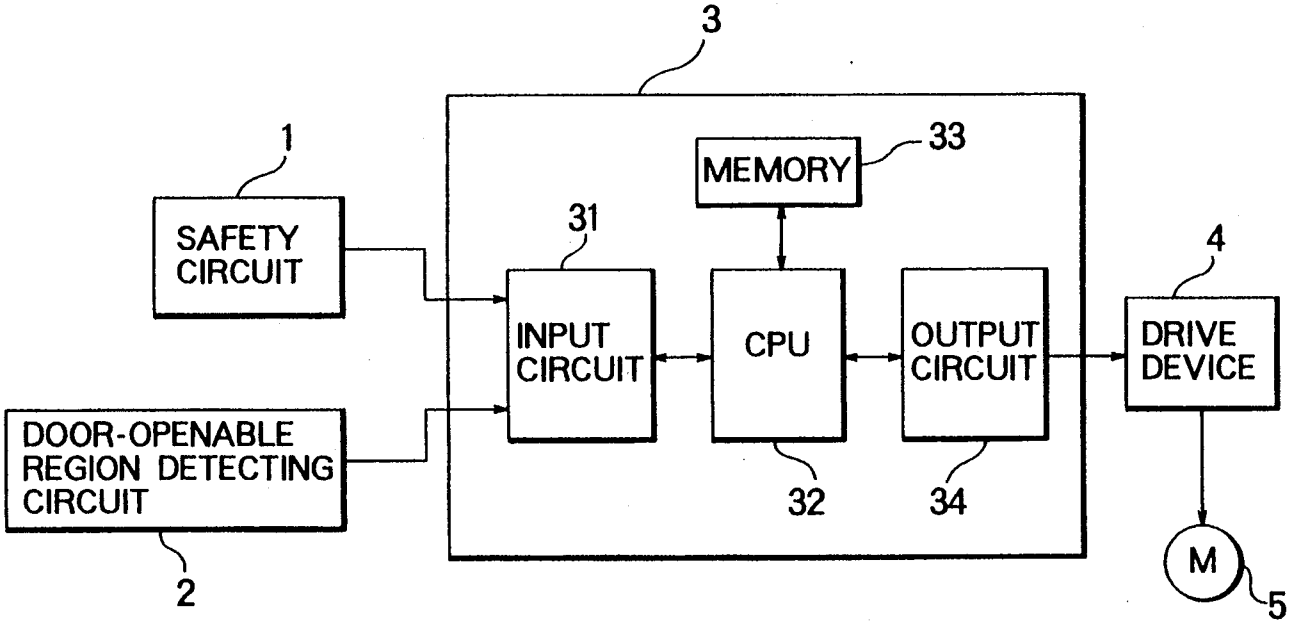
FIG. 3 PRIOR ART
FIG. 3 is a diagram showing the construction of a conventional elevator control apparatus.
Figure 4:
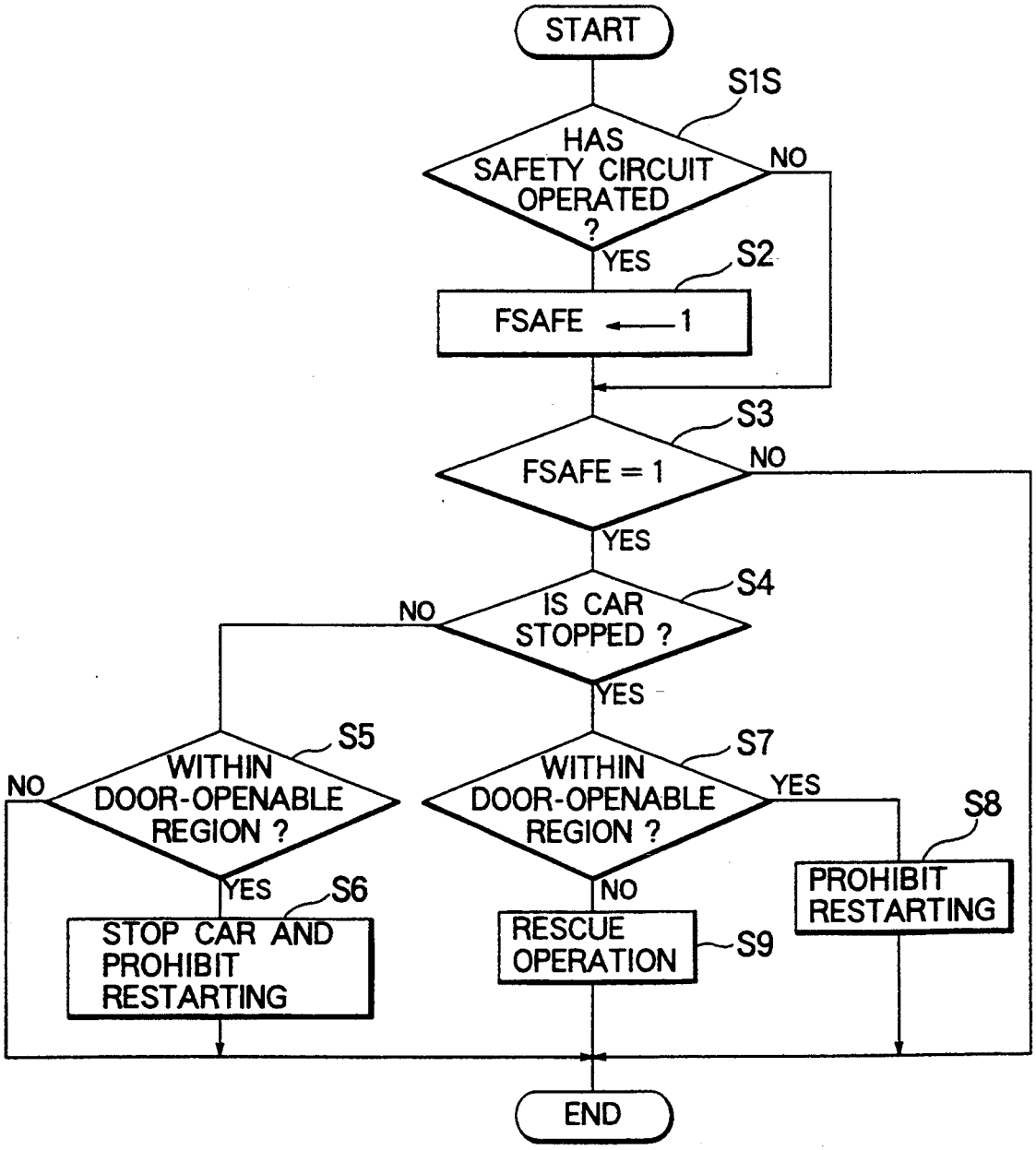
FIG. 4 PRIOR ART
FIG. 4 is a flowchart for explaining the operation of the apparatus shown in FIG. 3.

An embodiment of the present invention will now be described with reference to the drawings. FIG. 1 shows the construction of the embodiment. In FIG. 1, elements corresponding to those shown in FIG. 3 are denoted by identical reference numerals, and their descriptions will be omitted to avoid redundancy.

In FIG. 1, an elevator control apparatus includes a control circuit 3A using, for example, a microcomputer. The control circuit 3A includes a central processing unit (CPU) 32A connected to the input circuit 31 for mutual data exchange, a memory 33A which is connected to the CPU 32A for mutual data exchange, and in which data such as a program related to the flowchart shown in FIG. 2 has been previously stored, and an abnormality storing means 35 provided between the safety circuit 1 and the input circuit 31. The abnormality storing means 35 comprises, for example, a flip-flop whose output from the Q terminal is maintained at "1" until the input to the R terminal becomes "1" after the input to the S terminal has become "1". The CPU 32A includes a timer 320 for measuring first and second predetermined periods of time, described later. Since a control circuit 3A including such a CPU 32A usually includes a timer means for measuring time, the embodiment may use such a configuration. The flip-flop 35 may be provided separately from the control circuit 3A.

Figure 2:
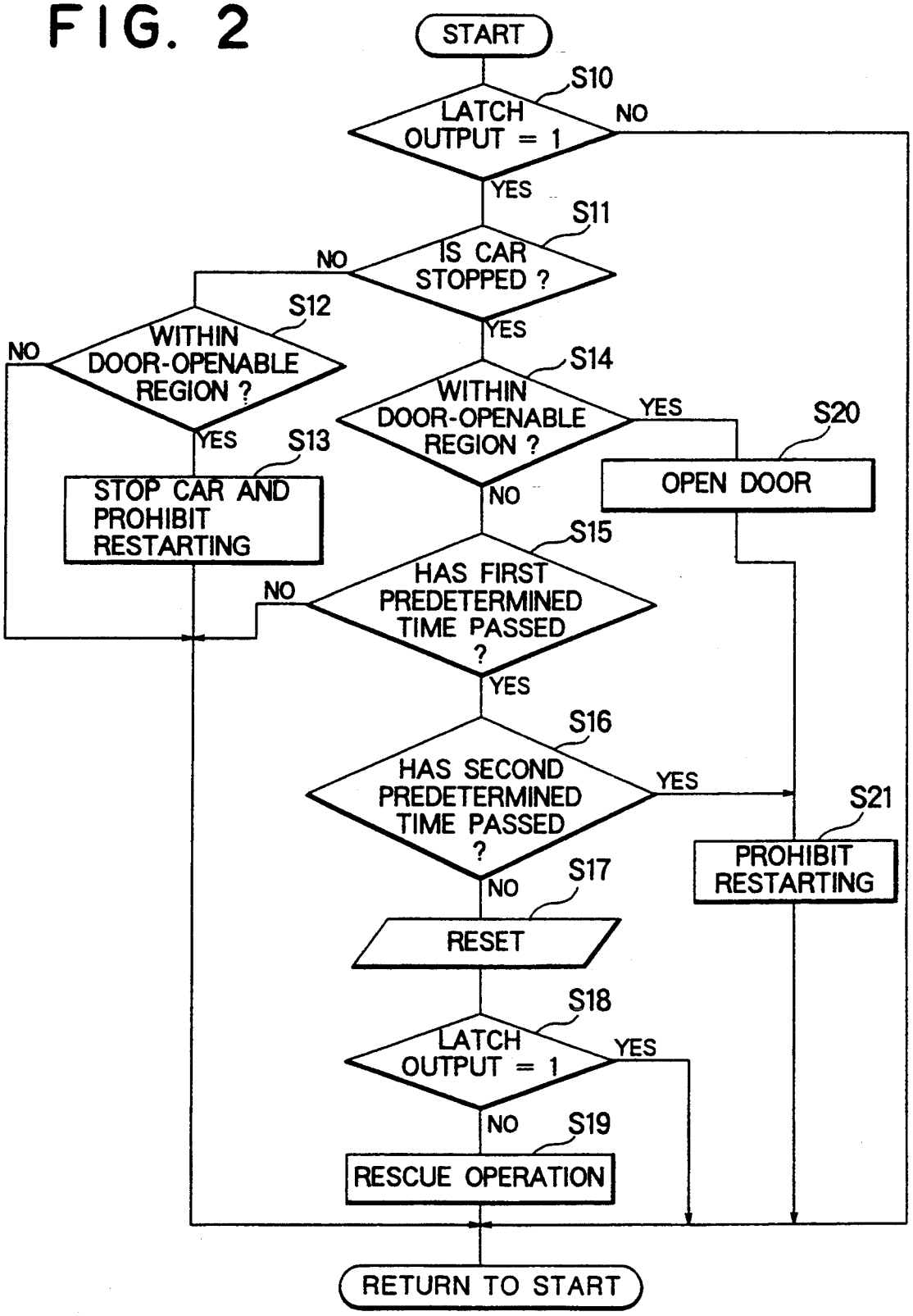
FIG. 2 is a flowchart for explaining the operation of the apparatus shown in FIG. 1.

The operation of the apparatus shown in FIG. 1 will be described with reference to FIG. 2. Suppose that an abnormality has occurred during the traveling of an elevator car (not shown), resulting in an operation of the safety circuit 1. The output signal of the safety circuit 1 becomes "1", and the output thereof latched in the flip-flop 35 also becomes "1". The output of the flip-flop 35 is fed via the input circuit 31 to the CPU 32A, and then processed in accordance with a program already stored in the memory 33A. Specifically, the CPU 32A determines whether or not the output of the flip-flop 35 is "1", in Step S10. Since the output is "1" Step S11 is executed, in which a determination is made as to whether or not the car is stopped. If the car is not stopped, Step S12 is executed to determine, on the basis of the output from the door-openable region detecting circuit 2, whether or not the car is within a door-openable region. If the car is not within a door-openable region, Step S10 is again executed. If the car is within a door-openable region, Step S13 is executed, in which a stop command is given to the drive device 4 via the output circuit 34, so as to stop the motor 5, hence, stop the car, and open the door of the car to allow passengers to get off the car, and in which restarting of the car is prohibited.

On the other hand, if the car is determined to be stopped in Step S11, CPU 32A executes Step S14 to determine, on the basis of the output from the door-openable region detecting circuit 2, whether or not the position at which the car has stopped in response to the operation of the safety circuit 1 is within a door-openable region. If that position is within a door-openable region, Step S20 is executed, in which the door is opened to allow the passengers to get off, and subsequently, Step S21 is executed, in which restarting of the car is prohibited. If it is determined, in Step S14, that the position at which the car is stopped is not within a door-openable region, Step S15 is executed, in which a determination is made as to whether or not a first predetermined period of time has passed since the car had been stopped by the CPU 32A. If the first predetermined period of time has not been passed, the execution of the program returns to Step S10. If the first predetermined period of time has passed, Step S16 is executed, in which it is determined whether or not a second predetermined period of time, longer than the first predetermined period of time, has passed since the stoppage of the car. If the second predetermined period of time has not passed, Step S17 is executed, in which a canceling signal (reset signal) is output to the flip-flop 35. Subsequently, Step S18 is executed, in which the CPU 32A determines whether or not the latch output of the flip-flop 35 is "1". If the output is not "1", that is, if the safety circuit 1 has returned to its initial state, Step S19 is effected, in which the CPU 32A commands, via the output circuit 34, the drive device 4 to perform an automatic low-speed operation, whereby the car is shifted to a rescue operation and starts traveling in this mode. When, after a car traveling in the rescue operation mode, the entrance of the car into a door-openable region has been determined in Step S12, Step S13 is executed, in which the car is stopped as described above, and the passengers are rescued at the nearest floor.

On the other hand, if the latch output of the flip-flop 35 is determined to be "1" in Step S18, the current loop is ended, and the execution of the program returns to Step S10. In the subsequent loop, it is again determined, in Step S16, whether or not the second predetermined period of time has passed since the stoppage of the car. If the second predetermined period of time has passed, this means that the latch output of the flip-flop 35 has not become "0" though the second predetermined period of time has passed, in other words, the safety circuit 1 keeps operating without returning to its initial state. In this case, Step S21 is executed, in which the car is prohibited from restarting.

As described above, according to the present invention, the outputting of a canceling signal is continued after the passage of a first predetermined period of time since the operation of the safety circuit 1 until a second predetermined period of time passes, so as to reset the flip-flop 35 for storing the operation of the safety circuit 1. With this arrangement, therefore, if the safety circuit 1 returns to its initial state between the passage of the first predetermined period of time and the passage of the second predetermined period of time, a rescue operation can be immediately entered. Thus, it is possible to reduce the risk of passengers being confined in the car. After the passage of the second predetermined period of time, the car is prohibited from starting. Therefore, it is possible to prevent damage to the used equipment as well as danger to the passengers.

It is preferable that the first and second predetermined periods of time are set at values which do not hinder the operational efficiency of the elevator.

In brief, according to the present invention, an elevator control apparatus has a safety circuit for detecting an abnormality of the elevator, a flip-flop for storing the operation of the safety circuit, a door-openable region detecting circuit for detecting that a position at which the car is stopped is within a region within which the door of the car can be opened, a control circuit for effecting a rescue operation on the basis of the outputs of the flip-flop and the door-openable region detecting circuit. When the safety circuit keeps operating even after a signal for canceling the memory of the abnormality storing means has been output, the outputting of the canceling signal is continued. If the safety circuit returns to its initial state during the continued outputting, a rescue operation can be immediately entered, thereby making it possible to reduce the risk of passengers being confined in the car. After the passage of a second predetermined period of time, the car is prohibited from starting, thereby making it possible to prevent damage to equipment as well as danger to passengers. Thus, it is possible to improve the level of safety.

What is claimed is:

1. An elevator control apparatus for controlling a drive device for a car of an elevator, comprising:

a safety circuit for detecting an abnormality of the elevator;

abnormality storing means for storing abnormality detection parameters;

a door-openable region detecting circuit for detecting that a position at which the car is stopped is within a region where the door of the car can be opened; and control means for controlling said drive device on the basis of the outputs of said abnormality storing means and said door-openable region detecting circuit such that when said abnormality storing means stores abnormality detection parameters, said control means stops the car within door-openable region if the car is in motion, opens the door to allow passengers to get off of the car, and, thereafter, prohibits restarting of the car, and wherein said control means opens said door to allow passengers to get off of the car if the car is stopped within a door-openable region, and, thereafter, prohibits restarting of the car, and wherein said control means continuously cancels, for a predetermined period of time, the abnormality detection parameters stored in said abnormality storing means if said car is stopped within a region within which the door cannot be opened, said control means effecting a rescue operation when the abnormality detection parameters have been canceled and said control means prohibiting restarting of said car when the abnormality detection parameters have not been cancelled.

2. An elevator control apparatus according to claim 1 wherein, after an abnormality detection by said safety circuit has been stored by said abnormality storing means but before a first predetermined period of time passes, said control means stops the car within a door-openable region if said car is in motion, opens the door to allow passengers to get off of the car, and, thereafter, prohibits restarting of the car, whereas and said control means opens the door to allow passengers to get off of the car if the car is stopped within a door-openable region, and, thereafter, prohibits restarting of the car, and said control means generates, after the passage of said first predetermined period of time, a canceling signal to said abnormality storing means if the car is stopped within a region within which the door cannot be opened, said control means effecting a rescue operation when the memory of said abnormality storing means has been canceled, said rescue operation comprising causing said car to travel at a speed lower than the normal speed to the door-openable region of the nearest floor, and then opening said door to allow passengers to get off the car, said control means continuing, until the passage of a second predetermined period of time, outputting the canceling signal if the memory of said abnormality storing means has not been canceled even though said canceling signal has been generated, said control means effecting a rescue operation upon the cancellation of the memory of said abnormality storing means, and said control means prohibiting restarting of said car if said cancellation has not been effected though said second predetermined period of time has passed.

3. An elevator control apparatus according to claim 2 wherein said control means comprises said abnormality storing means, said door-openable region detecting circuit, and a control circuit connected to said drive device for the car, said control circuit comprising a CPU, a memory storing a program in accordance with which said CPU performs the above-described operation, and a timer for measuring said first and second predetermined periods of time.

4. An elevator control apparatus according to claim 3 wherein said abnormality storing means comprises a flip-flop circuit provided in said control circuit.

5. A method of operating a stationary elevator car upon detection of an abnormality comprising:

storing a parameter indicative of an abnormality in a memory device;

detecting the position of the elevator car to determine whether the car is within a door-openable region;

measuring the amount of time that the car is stopped when the car is determined to be within a door-openable region;

transmitting a cancellation signal to the memory device when the amount of time that the car is stopped is greater than a first predetermined period of time and less than a second predetermined period of time;

driving the elevator car at low speed responsive to the an output from the memory device: and stopping the car when the car enters a door openable region.

6. A method as claimed in claim 5 further comprising prohibiting the car from restarting when the amount of time that the car is stopped is greater than the second predetermined period of time.

* * * * *